US005640742A

United States Patent [19]

White et al.

[11] Patent Number: 5,640,742

[45] Date of Patent: Jun. 24, 1997

[54] SPRING BADGE CLIP

[75] Inventors: Robert W. White, Franklin Lakes, N.J.; David J. Haas, Suffern, N.Y.

[73] Assignee: Temtec, Inc.

[21] Appl. No.: 579,137

[22] Filed: Dec. 27, 1995

[51] Int. Cl.[6] ..... A44B 21/00; A44C 3/00

[52] U.S. Cl. ..... 24/3.12; 24/18; 24/327; 24/543; 40/1.6

[58] Field of Search ..... 24/3.1, 3.6, 3.12, 24/13, 18, 543, 557, 327; 40/1.6, 641, 645, 633, 666

[56] References Cited

U.S. PATENT DOCUMENTS

| | | | |
|---|---|---|---|
| D. 314,015 | 1/1991 | Hickman, Sr. . | |
| 342,971 | 6/1886 | Ongley . | |
| 777,191 | 12/1904 | Engle | 24/327 |
| 926,401 | 6/1909 | Freedman . | |
| 1,212,511 | 1/1917 | Kropp . | |
| 1,765,431 | 6/1930 | Kupfer | 40/1.6 |
| 2,641,811 | 6/1953 | Morgan . | |
| 2,775,804 | 1/1957 | Ayoub . | |
| 3,135,034 | 6/1964 | Fauteux | 24/327 |
| 3,357,615 | 12/1967 | Hill . | |
| 3,405,429 | 10/1968 | Vazquez | 24/543 |
| 3,515,363 | 6/1970 | Fisher . | |
| 3,604,071 | 9/1971 | Reimels . | |
| 3,604,425 | 9/1971 | Le Roy . | |
| 3,616,497 | 11/1971 | Esposito, Jr. . | |
| 3,629,912 | 12/1971 | Klopp . | |
| 3,942,228 | 3/1976 | Buckman et al. . | |
| 3,983,602 | 10/1976 | Barry . | |
| 4,043,858 | 8/1977 | Dantowitz . | |
| 4,071,930 | 2/1978 | Tanaka . | |
| 4,228,569 | 10/1980 | Snyder . | |
| 4,277,863 | 7/1981 | Faneuf . | |
| 4,277,864 | 7/1981 | Orson, Sr. . | |
| 4,395,799 | 8/1983 | Batts . | |
| 4,763,390 | 8/1988 | Rooz . | |
| 4,835,824 | 6/1989 | Durham et al. . | |
| 4,839,947 | 6/1989 | Cohen et al. . | |
| 5,022,126 | 6/1991 | Davis . | |
| 5,159,730 | 11/1992 | Radvin . | |
| 5,179,768 | 1/1993 | Jio . | |
| 5,285,556 | 2/1994 | Shorin et al. . | |
| 5,305,500 | 4/1994 | Tucker . | |
| 5,313,721 | 5/1994 | Filden . | |
| 5,361,463 | 11/1994 | Revis . | |
| 5,384,935 | 1/1995 | Maier-Hunke . | |

FOREIGN PATENT DOCUMENTS

| | | | |
|---|---|---|---|
| 886098 | 11/1971 | Canada | 40/1.6 |
| 2278006 | 2/1976 | France | 24/557 |
| 4226341 | 2/1994 | Germany | 40/1.6 |
| 398487 | 9/1965 | Switzerland . | |
| 796846 | 6/1958 | United Kingdom . | |

*Primary Examiner*—Victor N. Sakran
*Attorney, Agent, or Firm*—Michael E. Zall

[57] ABSTRACT

A one piece spring clip is provided which includes first and second relatively stiff elongate arms. Each arm has a gripping portion at one end and a jaw portion at an opposite end. A web interconnects the arms intermediate their ends, the web forming a pivot for the arms. A substantially U-shaped spring having a first end and a second end is disposed between the gripping portions of the arms. The first end of the spring is flexibly connected to one arm. A detent is formed on the other arm. The second end of the spring is resiliently biased to engage the detent when the gripping portions of the arms are initially moved toward each other, the spring yieldingly holding the jaws closed. The second end of the spring is continuously engaged in the detent for subsequent pressure and relaxation of pressure on the gripping portions of the arms to pivot the arms about the web, whereby the clamping portions of arms are movable toward and away from each other for receiving and retaining an object therebetween. Identification indicia, such as a badge is removably mounted to the clip by one of a plurality of mounting members formed on the clip.

14 Claims, 6 Drawing Sheets

SPRING BADGE CLIP

BACKGROUND OF THE INVENTION

1. Field of the Invention

The present invention relates generally to spring clips, and particularly to a spring clip that is removably mountable to, for example, garments, for holding items such as a badge or other identifying indicia. More specifically, this invention relates to a clip that can be repeatedly used and is initially activated by the user to provide spring tension between the jaws of the clip to securely hold, for example, the user's pocket.

2. Description of the Related Art

Spring clips are well known in the art. Such clips are used for holding items such as badges, memos, documents, clothing, and anything else that will fit between the jaws of the clip.

There are many problems associated with the use of badge clips. Many millions of identification badges are worn yearly. The badges are usually intended to be disposable and the wearer may have physical disabilities which make the badge and badge clip difficult to attach to the garment. Prior clip devices have damaged garments, or been assembled from a plurality of parts making them expensive to manufacture. Many badge clips are also complicated, requiring detailed instructions for use. Such instructions are generally impractical for a user to understand the clip operation at, for example, the registration counter of a convention. Thus, the clip is used improperly and therefore, ineffectively, or not at all.

It is thus desirable that a badge clip be capable of being easily manipulated by the user with one hand, easily mountable to the users pocket, lapel or the like, nondamaging to the garment to which it is applied and capable of retaining the identification item or article reliably on the garment so that it does not fall off.

The following patents describe some of the known spring and badge clips:

U.S. Pat. Nos.

2,641,811 to Morgan 3,604,425 to Le Roy 3,616,497 to Esposito Jr.

3,629,912 to Klopp 4,043,858 to Dantowitz 4,071,930 to Tanaka 4,228,569 to Snyder 4,277,863 to Faneuf 4,227,864 to Orson, Sr.

4,395,799 to Batts 4,763,390 to Rooz 4,835,824 to Durham et al.

4,839,947 to Cohen et al.

5,022,126 to Davis 5,159,730 to Radvin 5,179,768 to Jio 5,285,556 to Shorin et al.

5,305,500 to Tucker 5,313,721 to Filden 5,361,463 to Revis 5,384,935 to Maier-Hunke et al.

Des. 314,015 to Hickman, Sr.

Des. 398,487 to Franco

Additional patents relating to spring or badge clips are Swiss Patent No. 398,487 and U.K. Patent No. 796,846.

Among the aforementioned art, the following are of particular interest:

U.S. Pat. No. 3,616,497 to Esposito, Jr. discloses an integral clamping instrument, molded of elastomeric material, for medical/surgical applications. The instrument includes a rigid bar acting as a fulcrum between a pair of arms the ends of which have jaw portions. The other ends of the arms are hingedly connected to opposite ends of a spreader which has two hinged sections adapted to provide a snap-action gripping of the jaws.

U.S. Pat. No. 3,629,912 to Klopp discloses a plastic clamp with a releasable locking lever between the arms. The arms are retained in the clamping position by the coaction between a rod-like member and a socket which are dimensioned and positioned for locking registry with each other.

U.S. Pat. No. 4,228,569 to Snyder discloses a two piece clip made of metal. The clip comprises a rigid base member having upward arms embracing a Z-shaped spring member. A fulcrum is provided where the arms meet the outer run of the spring member. Jaws are provided on the adjacent ends of the base member and spring member.

U.S. Pat. No. 4,277,863 to Faneuf discloses a clip molded of one unitary body of plastic. The clip is constructed to engage an ID card through an aperture therein. The clip has two elongate stiff parallel members joined at their middle by a flexible web forming a hinge. On one side of the hinge the members form opposed jaws and at the other side of the hinge one member forms a spring biased toward the other member to urge the jaws closed. The spring forms a loop capable of engaging through an aperture in an ID card. The loop is offset from the hinged members to allow the card to hang parallel alongside the hinged members.

U.S. Pat. No. 4,277,864 to Orson, Sr. discloses a spring operated clip with lever arms connected at one end with a spring portion which urges jaws into a mutual clamping engagement. The clip includes a fulcrum, consisting of a locking lug and detent. The jaws are urged open by squeezing together the outer end portions of the lever arms which pivot about the fulcrum to compress the spring. A post or stud having an enlarged head portion is provided on the outer surface of at least one arm to fasten an identity badge to such arm.

U.S. Pat. No. 4,395,799 to Batts discloses a spring biased plastic clamp for a garment hanger having a pair of leg portions joined at their ends by a bar between which a spring is disposed to bias the jaws into the clamping position.

U.S. Pat. No. 4,839,947 to Cohen et al. discloses a clamp mechanism for garments consisting of a unitary piece of resilient material. The clamp consists of a pair of arms and a hinged means disposed therebetween which consists of a cylindrical bearing element and a mating circular cylindrical axle element about which the arms are rotated. The distal ends of each arm portion opposite the jaws are joined to form a bias means between the arms that exerts outwardly directed forces against the arms so that the jaws will grip an item therebetween. The bias means is provided with spacers to confine the flex of the bias means to the central portion.

U.S. Pat. No. 5,022,126 to Davis discloses a one-piece plastic surgical towel clamp having arms with locking means disposed therebetween, each of which has inner surfaces with teeth to engage each other.

U.S. Pat. No. 5,159,730 to Radvin discloses a clip having two opposing members and an arcuate portion joining the two opposing members at their ends. Each of the opposing members have opposed jaw portions at the end portions opposite the arcuate portion. Locking arms are provided intermediate the opposite end portions of the opposing members for locking the opposing members together. The clip also includes projections on each of the opposing members for urging the arms into engagement and disengagement.

U.S. Pat. No. 5,179,768 to Jio discloses a clothes pin made of plastic as one unit. The clothes pin consists of two opposite pin plates and two elastic plates extending from the bottom ends of the two plates, respectively, and bending inward. One of the elastic plates has a stopper and two projections protruding upward and downward near the stopper which engages the other plastic plate to spread the pin plates so that the jaws open. An elastic bridge between the pin plates gives elasticity to the pin plates to recover elasticity to permit the jaws to pinch the clothes therebetween.

U.S. Pat. No. 5,361,463 to Revis discloses a one piece spring clip consisting of lower and upper face beams joined together by a transverse support member. The lower face beam has a latching hook and the upper face beam has a latching body to receive the hook. Squeezing together of the opposing beams interconnects the hook-tip and the latch receptacle to stress the pivot bar therebetween for the opening and closing of the jaw of the clip.

None of the aforementioned references discloses the spring mechanism of the present invention nor do these references disclose the particular relationship and coaction between the spring mechanism and the body structure of the clip of this invention. In particular, none of the references disclose a clip that can be repeatedly used and is initially activated by the user to provide spring tension between the jaws of the clip to securely hold, for example, the user's pocket. None of the patents disclose a clip device with these elements in combination with a support or mounting member to which a badge or other identifying indicia removably mounted.

OBJECTS AND SUMMARY OF THE INVENTION

It is an object of the present invention to provide a unitary spring clip particularly useful for the attachment of identity badges to garments.

It is another object of this invention to provide a spring clip which is adapted for injection molding in integral form.

It is yet another object of this invention to provide a clip capable of one handed operation which upon initial use, the spring of the clip is energized or activated to urge the jaws of the clip into mutual clamping engagement with each other, and thereafter does not require such activation for reuse thereof.

It is another object of the present invention to provide a clip constructed with at least one of a plurality of support members employed to removably mount a badge or other identifying indicia to the clip.

The foregoing objects of the present invention are accomplished by the one piece badge clip of the present invention. The clip includes first and second relatively stiff elongate arms. Each arm includes a gripping portion at one end of the arm and a jaw portion at a corresponding opposite end of the arm. A web joins the first and second arms intermediate their respective ends, the web forming a pivot or hinge for the arms. A substantially U-shaped spring having a first end and a second end is disposed between the gripping portions of the arms. The first end of the spring is flexibly connected to one arm. A detent means is formed on the other of such arms. The second end of the spring is resiliently biased to engage the detent when the gripping portions of the arms are initially moved toward each other, the spring arm yieldingly holding the jaws closed. The second end of the spring is continuously engaged in the detent for subsequent pressure and relaxation of pressure on the gripping portions of the arms to pivot the arms about the web, whereby the clamping portions of arms are movable toward and away from each other for receiving and retaining an object therebetween. Identification indicia, such as a badge, is removably mounted to the clip by one of a plurality of mounting members formed on the clip.

BRIEF DESCRIPTION OF THE DRAWINGS

For a more complete understanding of the present invention, reference may be had to the following description of exemplary embodiments of the present invention considered in connection with the accompanying drawings, in which.

DETAILED DESCRIPTION OF THE PREFERRED EMBODIMENTS

Figure 1:
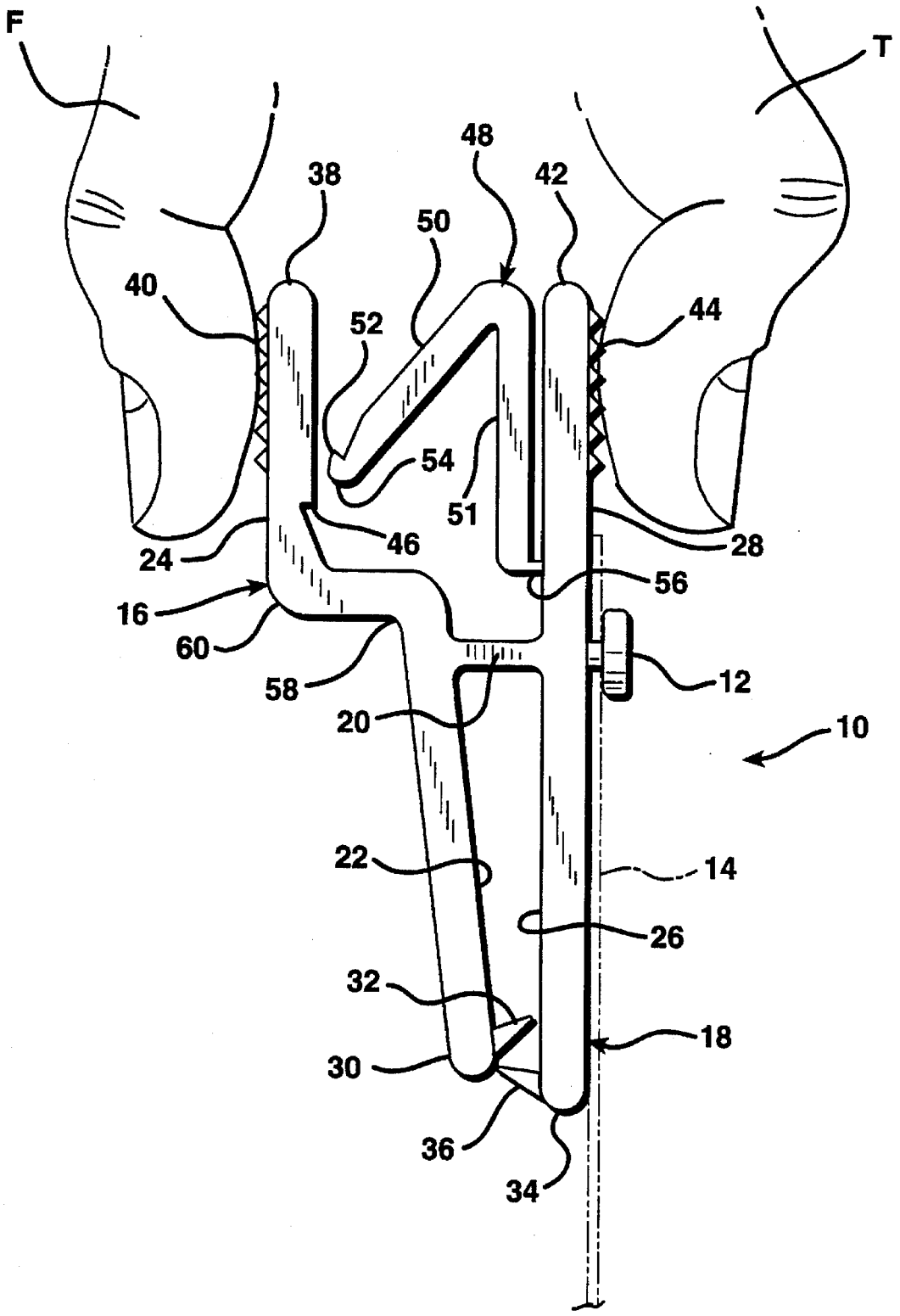
FIG. 1 is an elevational view of a preferred embodiment of a clip with a badge mounted thereto in accordance with the present invention.
Figure 2:
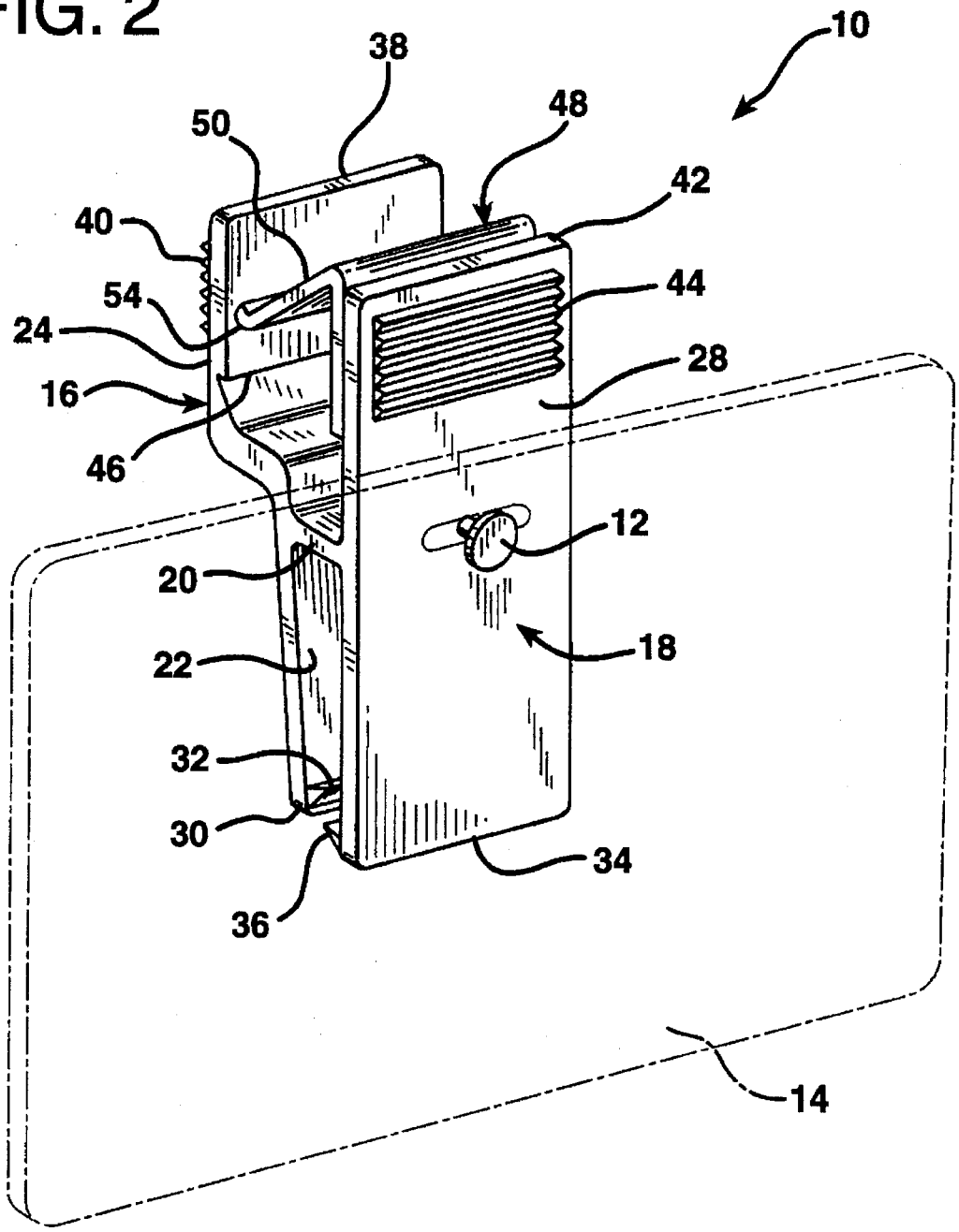
FIG. 2 is a perspective view of the preferred embodiment of the clip depicted in FIG. 1.

Referring to FIGS. 1–4, a preferred embodiment of a badge clip of the present invention is shown generally at 10 and includes a mounting member such as a stud 12 to which a badge 14 (represented by the phantom line) or other identifying indicia is removably mounted. Other embodiments of the mounting member 12 which may be used thereon, are shown and described hereinafter with reference to FIGS. 5A–5E. Other embodiments of the clip 10 are shown and described hereinafter with reference to FIGS. 7 and 8.

Preferably all embodiments of the clip 10 according to the present invention are formed as a unitary or one piece construction. By unitary or one piece, it is meant that the clip 10 is molded, stamped or otherwise formed from a blank or web of material.

The clip 10 includes a pair of arms 16,18 interconnected by a web member 20. The web member 20 is preferably formed integral with the pair of arms 16,18 and constructed to provide a smooth stable transition to the corresponding arms 16, 18 to which the ends of the web 20 are joined. Arm 16 has an inner surface 22 and an outer surface 24. Arm 18 has an inner surface 26 and an outer surface 28. A mounting member 12 extends from outer surface 28. Arm 18 is preferably a flat longitudinal member.

Still referring to FIGS. 1–4, one end 30 of the arm 16 is provided with a clasping member 32, such as a tooth or plurality of teeth along the inner surface 22 of the arm 16. One end 34 of the other arm is also provided with a similar clasping member 36. The teeth 32,36 are also preferably formed integral with the corresponding end portion 30,34 of the arm 16,18. The teeth 32,36 may have a triangular cross-sectional shape, although other cross-sectional shapes may be employed. It is preferred that the teeth 32,36 overlap when the jaws 16,18 are moved toward one another. Formation of the teeth 32,36 in this manner provides for a more secure clasping of the object, e.g., pocket, therebetween.

Figure 6:
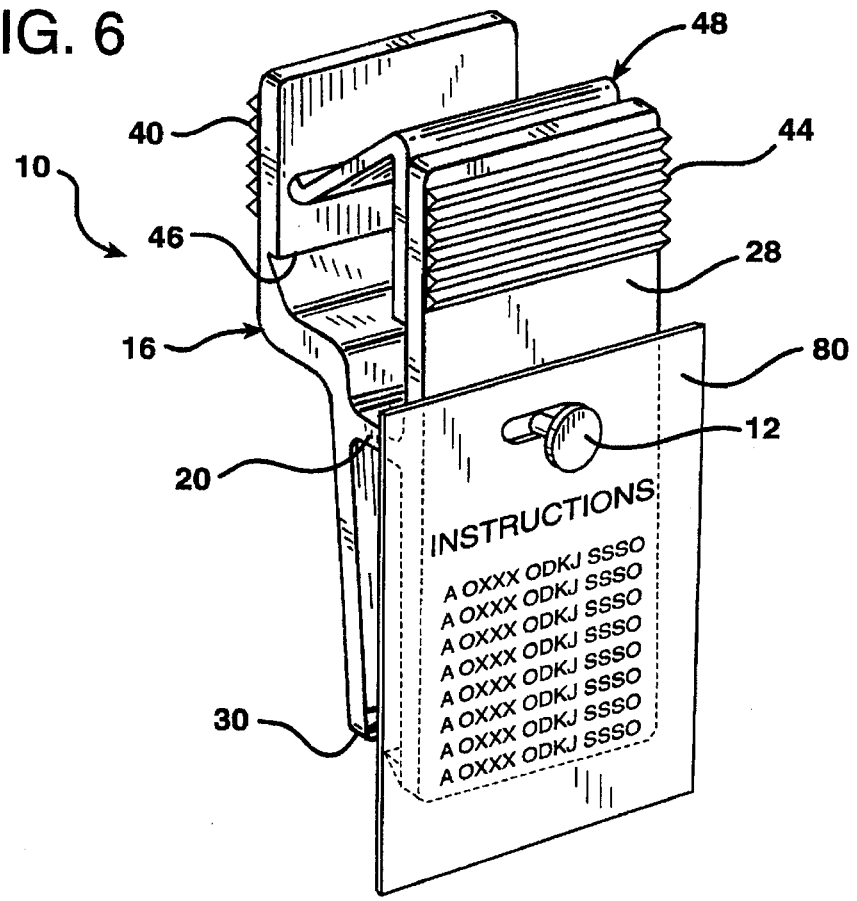
FIG. 6 is a perspective view of the preferred embodiment of the badge clip of the present invention, prior to activation, to which an instruction placard is removably mounted thereto.

The other end 38 of the arm 16 is provided with a gripping surface 40 along the outer surface 24. The other end 42 of the arm 18 is also provided with a gripping surface 44 along the outer surface 28. The gripping surfaces 40,44 are disposed along the respective outer surfaces 24,28 to comfortably receive a thumb T and forefinger F (or forefingers) of the user. The gripping surfaces 40,44 can be formed as elevated ridges having a triangular cross-section as shown, or can be formed by knurling the outer surfaces 24,28 to a selected depth for a desired roughness to facilitate gripping and use of the clip 10 of the present invention. Referring to FIG. 6, the gripping surfaces 40, 44 can also be formed on the outer surfaces 24, 28 of the arms 16, 18 to extend completely across the width of the arms 16, 18.

Still referring to FIGS. 1–4, the inner surface 22 of arm 16 is formed with a notch or detent 46. The notch 46 can be formed along the inner surface 22 of the arm 16 to extend completely across the width of the arm 16, as shown for example in FIG. 2.

A U-shaped spring arm 48 is provided. The spring arm 48 comprises a locking leg 50 and a support leg 51. The end 54 of locking leg 50 has a portion removed therefrom to form a locking pawl 52. The end 54 is preferably rounded or convex to facilitate movement of the locking pawl 52 along the inner surface 22 of the arm 16 and to coact with the detent 46.

Support leg 51 of spring arm 48 is attached through strut 56 to the inner surface 26 of arm 18 opposite the detent 46. Preferably, support leg 51 is attached to arm 18 through strut 56 so that it remains substantially parallel to arm 18 when the jaws 32,36 are closed.

Still referring to FIGS. 1–4, in a preferred construction, the arm 16 is formed with a bend 58 just above where web 20 is joined to the inner surface 22 of the arm 16. The arm 16 is again formed with another bend 60 to bring the portion of the arm 16 having the gripping surface 40 parallel to the portion of arm 18 having the gripping surface 44. The bends 58,60 in the arm 16 coact with the spring arm 48 and the arm 18 to store compressive force in the clip 10 to provide spring tension between the jaws of the clip to securely hold, for example, a shirt pocket 62 (see FIG. 4).

The arm 18 is preferably constructed as a substantially flat, co-planar member with its inner surface 26 perpendicularly mounted to the web 20.

Still referring to FIGS. 1–4, in operation, upon initial use and activation, the user holds the gripping surfaces 40,44 between the thumb T and forefinger F and applies pressure thereto. The pressure forces the spring arm 48 to be compressed therebetween as shown sequentially in FIGS. 1,3 and 4, respectively. Initially, the compressive force causes the convex surface 54 of the spring arm 48 to slide along the inner surface 22 of the arm 16 to a point where the locking pawl 52 is received by and seated in the detent 46 at the inner surface 22 of the arm 16. The pressure applied at this stage of the operation is sufficient to maneuver the spring arm 48 to a locked position with the arm 16. However, the pressure applied has not yet been sufficient to cause the arms 16,18 to pivot further about the web 20 to force the jaws 32,36 apart. This stage of the operation is known as the activation or "arming" stage of the clip 10, which stores energy in the spring arm 48. The clip 10 is, in effect, transformed from the configuration depicted in FIG. 1 to the configuration depicted in FIG. 3 and becomes spring loaded.

Figure 3:
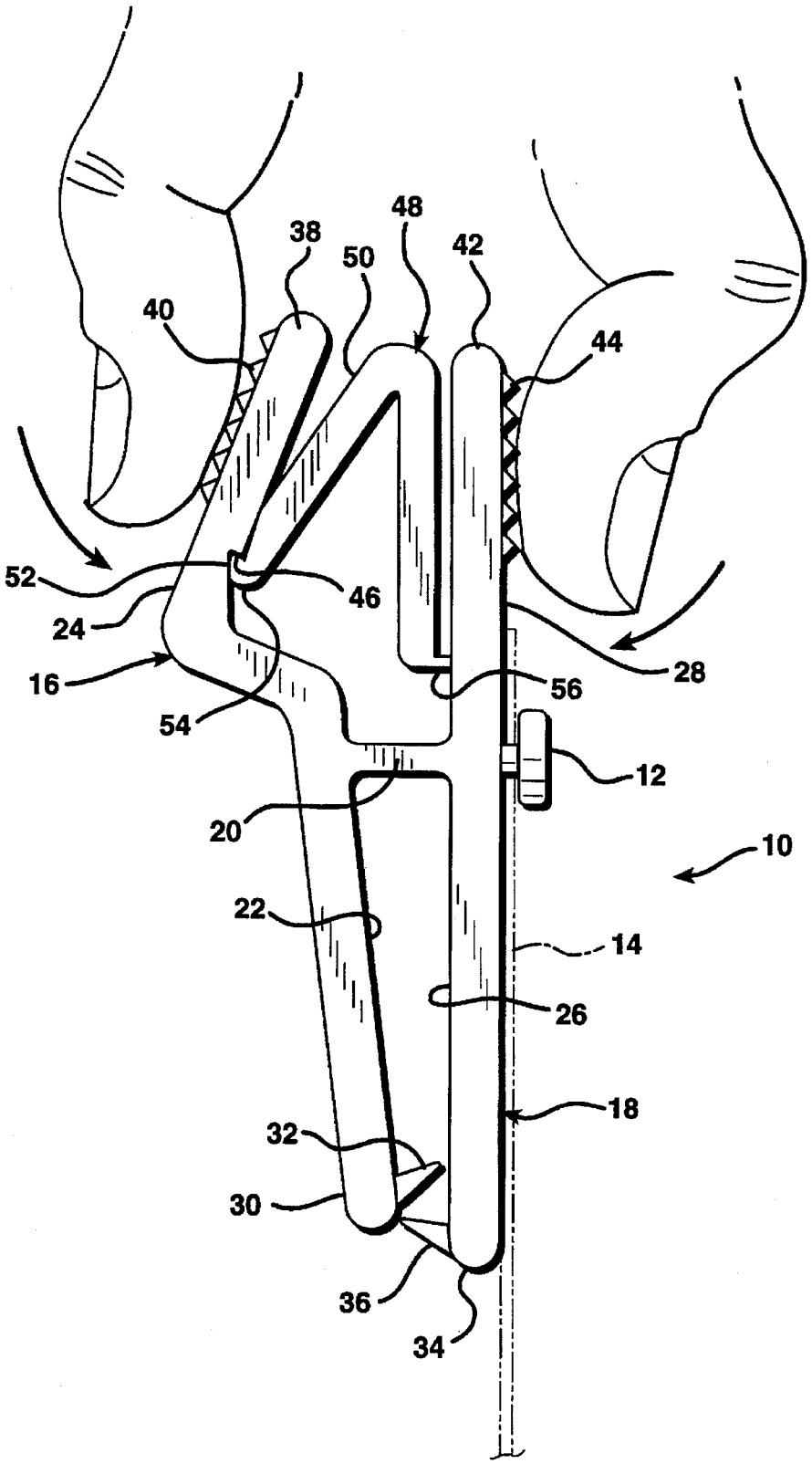
FIG. 3 is an elevational view of the embodiment of the clip depicted in FIG. 1 being initially activated by the user to provide spring tension between the jaws of the clip to securely hold, for example, the user's pocket.

As shown in FIG. 3, the locking pawl 52 once retained in detent 46 is prevented from unintentional removal therefrom so that the energy stored in the clip 10 is immediately available for the next stage of the clipping operation as well as repeated use.

Figure 4:
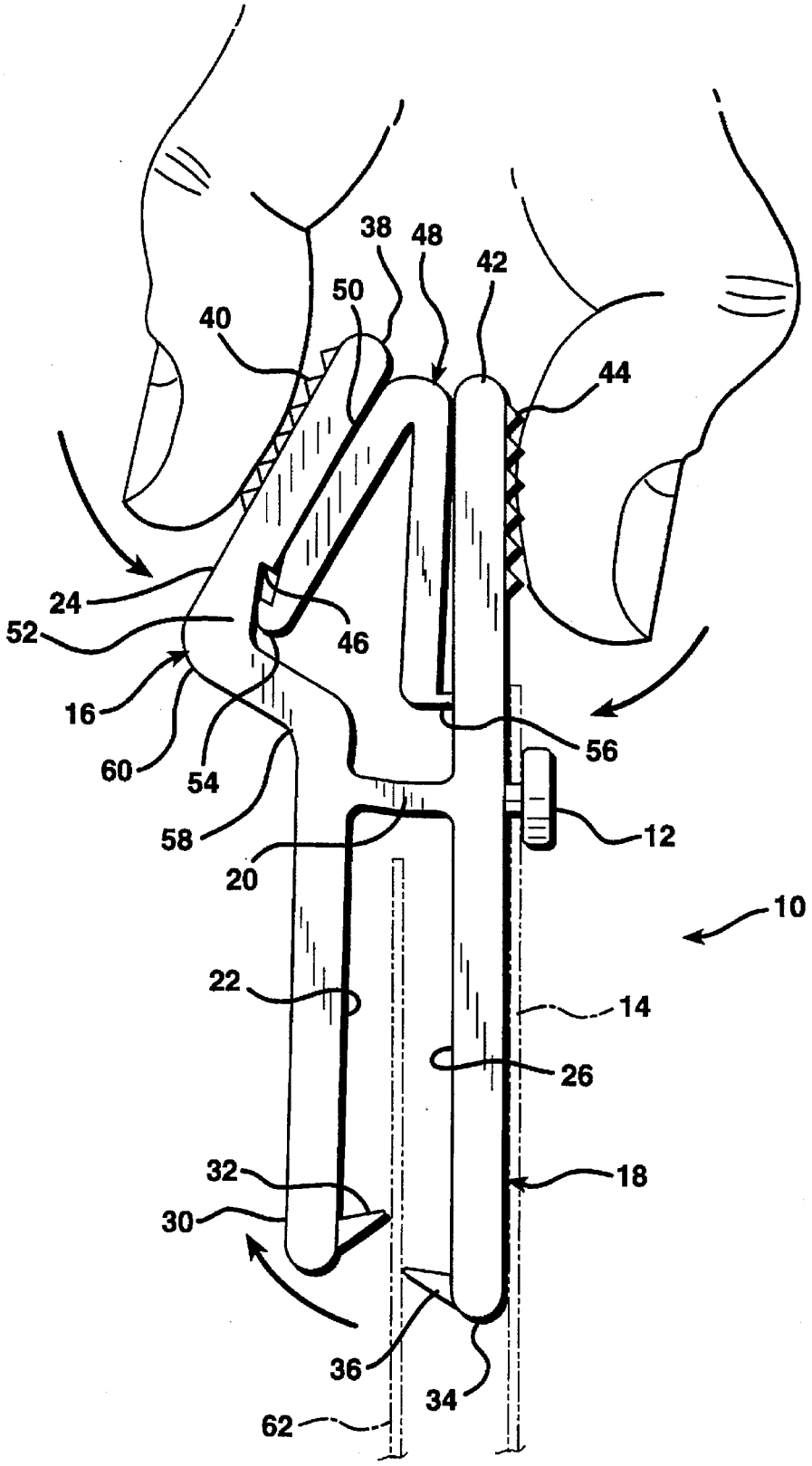
FIG. 4 is an elevational view of the clip just subsequent to activation as shown in FIG. 3 or upon reuse of the clip, wherein the jaws are in an open position for attachment to, for example, a pocket.

As shown in FIG. 4, subsequent compression of the gripping surfaces 40,44 will cause the arms 16,18 to pivot about the web 20 thereby forcing the ends 30,34 apart to receive, for example, the user's garment or other object therebetween. While arm 16 pivots about web 20, the rounded end 54 of the locking leg 50 slides over the inner surface 22 toward bend 60. As shown in FIG. 4, the web 20 during this stage of compression of spring arm 48 is slightly bent or bowed away from spring arm 48 so that the compressive forces transmitted through the arms 16,18 by finger T and F deploy the jaws 32,36 to the open position to receive a garment 62 or other object therebetween.

Removal of the pressure at the gripping surfaces 40,44 causes the locking pawl 52 to return and be retained in the detent 46 as shown in FIG. 3. The spring arm 48 resumes its shape thereby forcing apart the upper areas of the arms 16,18 so that the lower portion of the arms 16,18 pivot about the web 20 to bring the clasping members 32,36 into contact with the object therebetween.

The advantage of the clip 10 of the present invention is that single-handed operation may employed to activate the clip 10, thereby storing energy in the spring arm 48 so that the lower portion of the arms 16,18 can be repetitively opened and closed by applying or releasing pressure to the gripping surfaces 40,44.

FIGS. 5A–5E show alternate embodiments of the mounting member 12 for mounting the badge 14 or other identifying indicia to the clip 10 of the present invention.

Figure 5A:
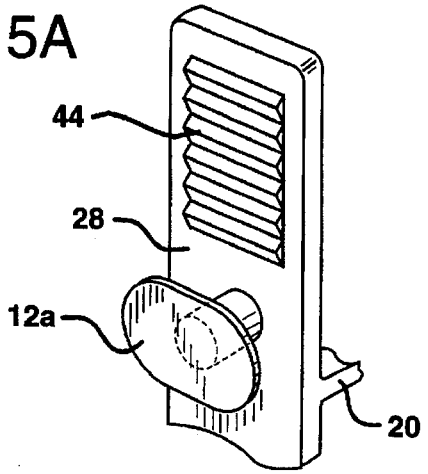
FIGS. 5A–5E are perspective views of various embodiments of mounting members for the clip of the present invention, to which badges or other identifying indicia are removably mounted.

FIG. 5A shows a mounting member **12*a* constructed as an oval or oblong-shaped member having a width equal to that of the arm 28** of the clip.

Figure 5B:
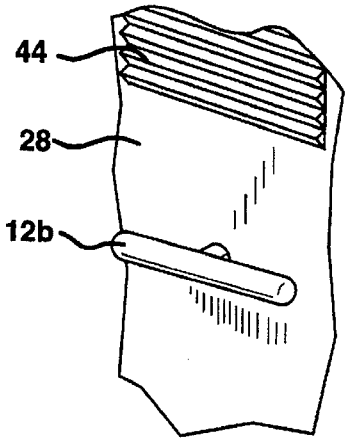

FIG. 5B shows a mounting member **12*b*** constructed as a T-bar structure.

Figure 5C:
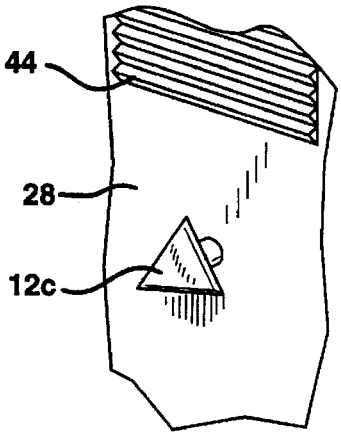

FIG. 5C shows a mounting member **12*c*** constructed with a triangular or pyramid shape.

Figure 5D:
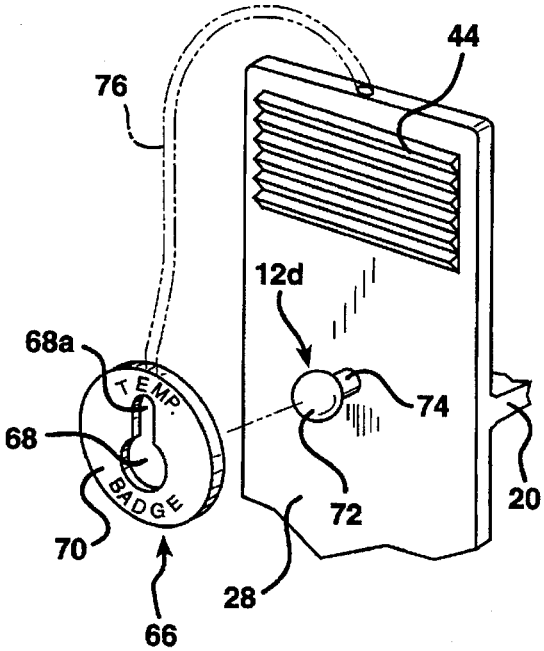

FIG. 5D shows a mounting member **12*d* as a mushroom-shaped stud. A disc 66 having a hole 68 therethrough is provided. The disc 68 is used to secure an identification badge (not shown) to the mounting member 12*d*. The disc 66 may display on an exterior surface 70 thereof an identifying indicia or a logo. As shown in FIG. 5D, the hole 68 is key shaped with a thinner portion 68*a*. The disc 66 can be used with the stud 12 as shown in FIGS. 1–4, as well as the mushroom-shaped stud 12*d* depicted in FIG. 5D. The bulbous head 72 of the stud 12*d* is guided through the hole 68** which has a diameter sufficient to receive the head 72. After the head 72 is passed therethrough, shank 74 of stud 12*d* is moved into the thinner portion 68*a* to prevent the bulbous head portion from being withdrawn back through hole 68. A flexible attachment member 76, such as a lanyard, string or the like, has one end attached to the disc 66 and an opposite end attached to the clip 10 at the arm 18. The lanyard 76 acts to retain the disc 66 on the stud 12 and to prevent loss of the disc 66 when it is removed from the stud 12 for removing or changing the badge.

Figure 5E:
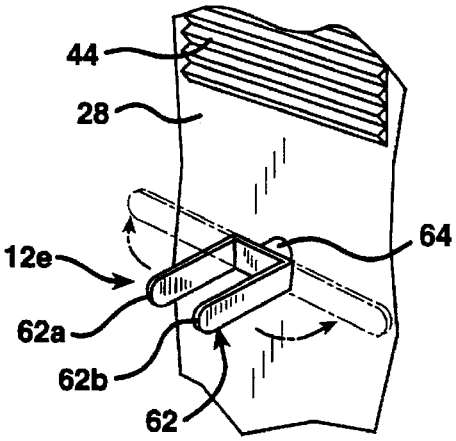

FIG. 5E shows a mounting member 12*e* which consists of a flexible member 62 mounted to the clip 10 by a rivet 64. Portions 62*a*,62*b* of the flexible member 62 are bent to extend into a direction away from the clip 10 so that they can be guided through a mounting hole in the badge (not shown). The portions 62*a*,62*b* are then moved to a flattened position, respectively, against the clip 10 as indicated by the broken lines to hold the badge to the clip 10.

Referring to FIG. 6, a longitudinal member 80 formed as a placard with a hole therethrough may be provided with each clip 10. The placard is removably mounted to the stud 12 of the clip 10. The placard can include instructions, promotional copy or other written or artistic copy.

Figure 7:
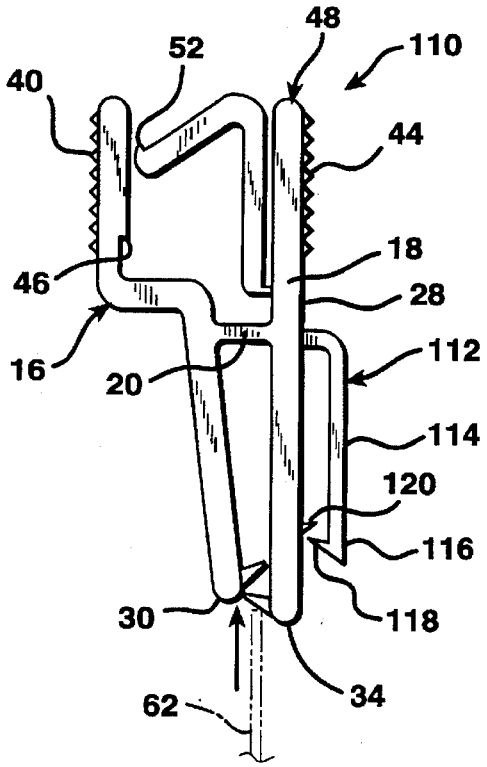
FIG. 7 is an elevational view of another embodiment of a badge clip according to the present invention.

FIG. 7 shows another embodiment of the clip of the present invention and is generally referred to as 110. The clip 110 is provided with a sub-assembly 112 which includes an arm 114 integrally, spring attached to arm 18 on surface 28. Arm 114 extends from and is disposed parallel to arm 18. Arm 114 includes a distal end 116 terminating in a tooth member 118 or other gripping member which coacts with another tooth 120 or other gripping member formed at the surface 28 of the arm 18. The sub-assembly 112 is constructed and arranged to facilitate mounting of the ID badge or placard 80 to the clip 110.

Figure 8:
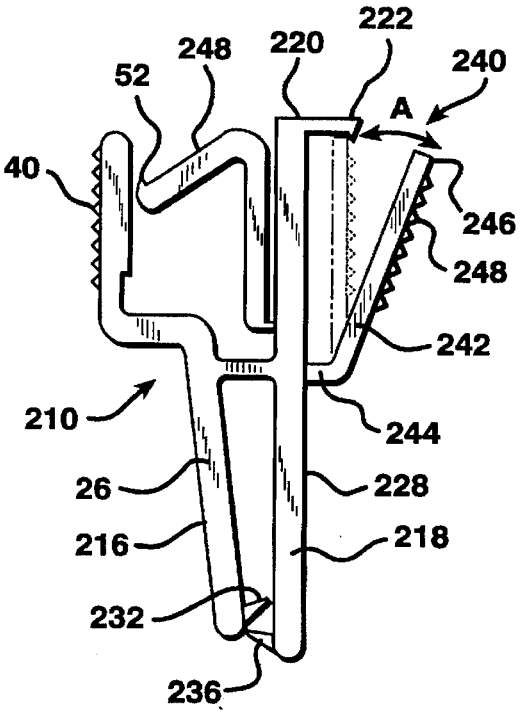
FIG. 8 is an elevational view of still another embodiment of a badge clip according to the present invention.

FIG. 8 discloses yet another embodiment of the clip of the present invention which is generally referred to as 210. The clip 210 is constructed with an arm 218, the upper end of which is provided with an extension 220 which terminates in a notched end 222. The extension 220 extends away from the spring arm 248 of the clip 210. The clip 210 also includes a sub-assembly 240 which consists of pivotal arm 242. The pivotal arm 242 is joined to the outer surface 228 of the arm 218 at a flexible hinge 244. Exterior surface 246 of the arm 242 is formed with gripping ridges 248. The arm 242 is passed through a hole in the placard 80 or ID card (not shown) and then moved in the direction of arrow A toward the arm 218. The end of the arm 242 is releasably engaged with the notched end 222 of the extension 220 by being "snapped" into place. Thus, it is possible with the clip 210 to simultaneously lock the identification badge in place and initially activate the spring arm 248 to provide spring tension between the jaws 232,236 of the clip 210 to securely hold, for example, the user's pocket.

The clip 10 of the present invention is preferably formed of a polymeric material so that it is resilient, non-corrosive and will not damage the user's clothing or any object to which it is removably attached. The clip 10 is preferably formed as a one piece construction, such as from a mold, and can be produced in a variety of different colors as desired.

The clip of this invention may be made from a wide variety of synthetic organic resins, including thermoplastic and thermosetting resins. The thermosetting resins that may be used are certain polyester resins. The thermoplastic resins that may be used are certain polyamides, polycarbonates, high density polyethylenes, vinyl polymers and copolymers, polypropylene, and ABS (acrylonitrile-butadiene-styrene) resins. Polypropylene resins are one of the preferred resins because the cured plastics formed therefrom have excellent properties, including substantial immunity to flex fatigue, exceptional resistance to environmental stress and cracking, and outstanding resilience and memory properties.

It is understood that the embodiments described herein are merely exemplary and that a person skilled in the art may make many variations and modifications without departing from the spirit and scope of the invention. For example, it is understood, that the reference herein to a clip capable of being removably attached to a pocket, lapel or other flap of a garment of a wearer, to retain a badge or the like, includes other uses of the clip without limitation. All such modifications and variations are intended to be included within the scope of the invention as defined in the appended claims.

What is claimed is:

1. A one piece spring clip for the attachment of an identity badge to a garment comprising:

first and second relatively stiff elongate arms, each arm including a gripping portion at one end of the arm, a jaw portion at the other end of the arm, a web joining the two arms intermediate their ends, the web forming a pivot for the arms;

a mounting member extending from a surface of one arm for releasably engaging the identity badge;

a substantially U-shaped spring having a first end and a second end disposed between the gripping portions of the arms, the first end of the spring flexibly connected to one arm and the other end in slidable contact with the other arm; a detent means on the other arm;

the second end of the spring arm resiliently biased to slide along the other arm and engage the detent when the gripping portions of the arms are initially moved toward each other, the spring yieldingly holding the jaws closed;

the second end of the spring being engaged in the detent during subsequent pressure and relaxation of pressure on the gripping portions of the arms to pivot the arms about the web, whereby the clamping portions of arms are movable toward and away from each other for receiving and retaining the garment therebetween.

2. A spring clip of single piece construction for the attachment of an identity badge to a garment, comprising:

a first relatively stiff elongate arm, the first arm comprising:

a first gripping portion at one end of the first arm, a first jaw portion at an opposite end of the first arm;

a second relatively stiff elongate arm, the second arm comprising:

a second gripping portion at one end of the second arm, a second jaw portion at an opposite end of the second arm;

a web disposed between the first arm and the second arm, the web comprising:

a first end connected to the first arm intermediate the opposed ends of the first arm, a second end connected to the second arm intermediate the opposed ends of the second arm, the web forming a pivot for the first and second arms;

a mounting member extending from a surface of one arm for releasably engaging the identity badge;

a detent constructed and arranged on the first arm, the detent facing the second arm; and a substantially U-shaped biasing member having a first end and second end, the first end flexibly connected to the second arm, the second end extending toward the first arm and in slidable contact with the first arm, the second end slidably movable along the first arm to engage the detent when the first gripping portion and the second gripping portion are initially moved toward each other, the biasing member yieldingly holding the first jaw portion and the second jaw portion in a substantially closed position, the second end of the biasing member being engaged in the detent by subsequent application and relaxation of pressure on the first and second gripping portions of the corresponding first and second arms pivoting about the web, whereby the first and second jaw portions of the corresponding first and second arms are moveable toward and away from each other for retaining and receiving the garment therebetween.

3. The spring clip according to claim 2, wherein the mounting member comprises an oblong-shaped stud.

4. The spring clip according to claim 2, wherein the mounting member comprises a T-bar shaped stud.

5. The spring clip according to claim 2, wherein the mounting member comprises a triangular-shaped stud.

6. The spring clip according to claim 2, wherein the mounting member comprises:

a stud-like member, a plate-like member formed with an aperture therethrough, the aperture sized and shaped to receive the stud-like member there through for releasable engagement therewith, and a flexible member interconnecting the plate-like member with one of the first and second arms;

the plate-like member retained with the spring clip by the flexible member.

7. The spring clip according to claim 2, wherein the mounting member comprises:

a pair of flexible arms moveable between a first position where the flexible arms are substantially parallel to receive the badge, and a second position where the flexible arms are moved in a direction away from each other to retain the badge to the spring clip.

8. The spring clip according to claim 2, wherein the mounting member is formed integral with one of the first and second arms.

9. The spring clip according to claim 2, wherein the mounting member comprises:

a mounting arm connected at one end to one of the first and second arms and extending to a distal end for coaction with one of the first and second arms, a gripping member disposed at the distal end of the mounting arm.

10. A one piece spring clip for the attachment of an identity badge to a garment, comprising:

first and second relatively stiff elongate arms, each arm including a gripping portion at one end of the arm, a jaw portion at the other end of the arm, a web joining the two arms intermediate their ends, the web forming a pivot for the arms;

a substantially U-shaped spring having a first end and a second end disposed between the gripping portions of the arms, the first end of the spring flexibly connected to one arm;

a detent means on the other of such arms;

the second end of the spring arm in slidable contact with the other arm and resiliently biased to slide along the other arm and to engage the detent when the gripping portions of the arms are initially moved toward each other, the spring arm yieldingly holding the jaws closed;

the second end of the spring being engaged in the detent during subsequent pressure and relaxation of pressure on the gripping portions of the arms to pivot the arms about the web, whereby the clamping portions of arms are movable toward and away from each other for receiving and retaining the garment therebetween; and a mounting system comprising:

a mounting member extending from one of the first and second arms for releasably receiving the identification badge for support at the spring clip, a plate-like member formed with an aperture there through, the aperture sized and shaped to receive the mounting member there through for releasable engagement therewith, and a flexible member interconnecting the plate-like member with one of the first and second arms, the plate-like member retaining the spring clip by the flexible member.

11. A one piece spring clip of single piece construction for the attachment of an identity badge to a garment, comprising:

first and second relatively stiff elongate arms, each arm including a gripping portion at one end of the arm, a jaw portion at the other end of the arm, and a web joining the two arms intermediate their ends, the web forming a pivot for the arms;

a substantially U-shaped spring having a first end and a second end disposed between the gripping portions of the arms, the first end of the spring flexibly connected to one arm;

a detent means on the other of such arms;

the second end of the spring arm in slidable contact with the other arm and resiliently biased to slide along the other arm and to engage the detent when the gripping portions of the arms are initially moved toward each other, the spring arm yieldingly holding the jaws closed;

the second end of the spring being engaged in the detent during subsequent pressure and relaxation of pressure on the gripping portions of the arms to pivot the arms about the web, whereby the clamping portions of arms are movable toward and away from each other for receiving and retaining the garment therebetween; and a pair of flexible arms mounted to one of the elongate arms moveable between a first position where the flexible arms are substantially parallel to receive the badge, and a second position where the flexible arms are moved in a direction away from each other to retain the badge to the spring clip.

12. A one piece spring clip of single piece construction for the attachment of an identity badge to garment, comprising:

first and second relatively stiff elongate arms, each arm including a gripping portion at one end of the arm, a jaw portion at the other end of the arm, and a web joining the two arms intermediate their ends, the web forming a pivot for the arms;

a substantially U-shaped spring having a first end and a second end disposed between the gripping portions of the arms, the first end of the spring flexibly connected to one arm;

a detent means on the other of such arms;

the second end of the spring arm in slidable contact with the other arm and resiliently biased to slide along the other arm to engage the detent when the gripping portions of the arms are initially moved toward each other, the spring arm yieldingly holding the jaws closed;

the second end of the spring being engaged in the detent during subsequent pressure and relaxation of pressure on the gripping portions of the arms to pivot the arms about the web, whereby the clamping portions of arms are movable toward and away from each other for receiving and retaining the garment therebetween; and a mounting assembly comprising:

a mounting arm extending from one of the first and second arms, the mounting arm coacting with a closest one of the first and second arms, a retaining member constructed and arranged to extend from the mounting arm for movement with the mounting arm to and from the closest one of the first and second arms to retain the identity badge therebetween.

13. A one piece spring clip of single piece construction for the attachment of an identity badge to a garment, comprising:

a first relatively stiff elongate arm, the first arm comprising:

a first gripping portion at one end of the first arm, a first jaw portion at an opposite end of the first arm;

a second relatively stiff elongate arm, the second arm comprising:

a latching member extending from the end of the second arm and facing away from the first arm, the latching member having a retaining portion formed thereon, a mounting member extending from the second arm, the mounting member having a second gripping portion formed thereon and moveable between a first position wherein the mounting member releasably engages the retaining portion of the second arm to retain the identity badge therebetween, and a second position wherein the mounting arm is removed from the retaining portion to permit insertion and removal of the identity badge between the second arm and the mounting arm, a second jaw portion at an opposite end of the second arm;

a web disposed between the first arm and the second arm, the web having a first end connected to the first arm intermediate the opposed ends of the first arm, and a second end connected to the second arm intermediate the opposed ends of the second arm for forming a pivot for the first and second arms;

a detent constructed and arranged on the first arm, the detent facing the second arm;

a substantially U-shaped biasing member having a first end and a second end, the first end flexibly connected to the second arm, the second end extending toward the first arm and in slidable contact with the first arm, the second end slidably movable along the first arm to engage the detent when the first gripping portion and the second gripping portion are initially moved toward each other, the biasing member yieldingly holding the first jaw portion and the second jaw portion in a substantially closed position, the second section of the biasing member being engaged in the detent by subsequent application and relaxation of pressure on the first and second gripping portions of the corresponding first and second arms pivoting about the web, whereby the first and second jaw portions of the corresponding first and second arms are moveable toward and away from each other for retaining and receiving the garment therebetween.

14. A one piece spring clip for the attachment of an identity badge to a garment, the clip comprising:

a pair of flexible arms, each one of the arms formed with a corresponding gripping portion and one of the arms formed with a depressed region;

a mounting member extending from a surface of one arm for releasably engaging the identity badge;

a web interconnecting the pair of arms and about which the pair of arms pivot; and a spring member comprising:

a first end connected to one of the pair of arms opposite to the arm with the depressed region, and a second end in slidable contact with the arm with the depressed region for sliding into releasable engagement with the depressed region;

wherein pressure applied to the pair of arms pivots the pair of arms about the web for the second end of the spring member to slide into and engage the depressed region to store energy, and subsequent pressure and removal of the pressure applied to the pair of arms pivots the pair of arms further about the web to move the corresponding gripping portions of the pair of arms away from each other to receive the garment therebetween and toward each other for gripping the garment therebetween.

* * * * *